United States Patent [19]

Asbury, Jr. et al.

[11] Patent Number: 4,917,327

[45] Date of Patent: Apr. 17, 1990

[54] TAPE DISPENSER

[75] Inventors: Charles E. Asbury, Jr., Vancouver, Wash.; Boris Boltak, Portland, Oreg.; Victor H. Clausen, Vancouver, Wash.

[73] Assignee: H. B. Fuller Company, Vancouver, Wash.

[21] Appl. No.: 241,418

[22] Filed: Sep. 7, 1988

[51] Int. Cl.[4] ..... B65H 59/38; B65H 19/29

[52] U.S. Cl. ..... 242/156; 242/58.4; 242/75.3; 242/75.4; 242/125.1

[58] Field of Search ..... 242/58.1, 58.2, 58.3, 242/58.4, 58.5, 156, 156.2, 75.4, 75.45, 58.6, 75.3, 147 R, 153, 164, 125.1

[56] References Cited

U.S. PATENT DOCUMENTS

| | | | |
|---|---|---|---|
| 2,651,474 | 9/1953 | Van Dusen | 242/58.4 X |
| 2,724,426 | 11/1955 | Bell et al. | 242/58.4 X |
| 2,974,839 | 3/1961 | Batlas et al. | 242/58.4 X |
| 3,089,665 | 5/1963 | Gardner, Jr. | 242/156 |
| 3,482,800 | 12/1969 | Barnett et al. | 242/75.4 X |
| 3,559,909 | 2/1971 | Whiteman | 242/75.45 X |
| 3,625,446 | 12/1971 | Floyd | 242/75.4 X |
| 3,730,811 | 5/1973 | Wendt | 242/58.4 X |
| 3,731,889 | 5/1973 | Alexeff | 242/156.2 |
| 3,915,264 | 10/1975 | Ohi | 242/75.4 X |
| 4,612,080 | 9/1986 | Aiuola et al. | 242/58.5 X |

FOREIGN PATENT DOCUMENTS

| | | | |
|---|---|---|---|
| 0230593 | 10/1960 | Australia | 242/156.2 |
| 2185241 | 7/1987 | United Kingdom | 242/75.4 |

OTHER PUBLICATIONS

"Sesame Hot Melt Tape Dispenser Model LM-0900 Series For Corrugated Board Reinforcement Use," H. B. Fuller Company, Jan. 1988.

*Primary Examiner*—Donald Watkins

*Attorney, Agent, or Firm*—Klarquist, Sparkman, Campbell, Leigh & Whinston

[57] ABSTRACT

A tape dispenser includes an automatic tension control mechanism and provision for auto-splicing the tail portion of one tape to the leading portion of another. The tensioning mechanism includes a brake band that extends at least partially about a tape spindle and is tensioned in response to the position of a spring-biased tensioning roller over which the tape is routed.

21 Claims, 9 Drawing Sheets

TAPE DISPENSER

FIELD OF THE INVENTION

The present invention relates to automatic tape dispensing systems, and more particularly to apparatuses for splicing and tensioning tapes in such systems.

BACKGROUND AND SUMMARY OF THE INVENTION

Modern consumer and industrial packaging often includes reinforcing tapes or tear tapes as part of their construction. Various tape dispensers have been devised to dispense such tapes into corrugator and packaging equipment. However, all have certain drawbacks.

One of the principal drawbacks of the prior art systems is in their techniques for changing from one spool of tape to another when the first spool becomes depleted. Many systems require that the packaging line be halted while a new spool of tape is installed and threaded through the appropriate tape guides. This interruption is intolerable in complex packaging lines which rely, for their cost effectiveness, on continuous, uninterrupted operation.

To partially alleviate the interruption problem, some tape dispensing systems rely on a human operator to stand at the ready and manually splice the tapes together. The operator loops the leading end of a replacement spool of tape about the free running tape on the first spool. When the first spool is nearly depleted, the corrugator or packaging equipment is slowed to about one third of its normal speed and the operator cinches the loop onto the free running tape to form a splice knot. At the same instant he manually spins the second spool to overcome its static inertia so that the machine can draw tape therefrom.

This approach, although an improvement, has several problems. One is that it requires a skilled operator to monitor the tape spools and be ready to tie the splicing knot at the critical instant. Another problem is that it requires the packaging equipment be slowed from its usual speed. Still another problem is that, even if the splice is successfully made (and often it is not), the operator's manual acceleration of the second spool may not be sufficient to prevent the tape from breaking when the packaging line suddenly starts pulling several hundred of feet of tape per minute from the spool. A tape break, of course, requires that the packaging line be stopped, the very problem that was sought to be avoided. Yet another problem is that some slack may be momentarily introduced into the second tape by the operator's manual spinning of the spool. This slack permits the tape to change its orientation and may result, for example, in an adhesive tape being applied to the packaging wrong side down.

Accordingly, a need remains for an improved technique for splicing from one spool of tape to another in an automatic packaging line so that the packing line can reliably operator without interruption.

A further need remains for an improved system for controlling the tension and orientation of the tapes during a splicing operation so that the spliced tape is not broken nor applied with the wrong orientation.

It is the object of the present invention to fulfill these and other needs.

According to one embodiment of the present invention, a spool of tape is provided with end elements that cooperate with end elements on the next spool of tape to make the tapes self splicing. One tape, for example, can be provided near its trailing end with a pin extending thereacross. The second tape can be provided at its leading end with a loop sized so that the pin cannot pass therethrough. When the pin engages the loop, the tapes become linked, causing the trailing end of the first tape to pull the leading end of the second tape into the packaging equipment.

The second spool of tape may be stationary when the splice is made. To prevent the tape from breaking under the strain of instantaneous acceleration, the tape path is provided with a movable roller guide. In one embodiment, this roller guide moves against the force of a spring and acts to shorten the tape path when the tension in the tape increases. The shortened tape path provides the packaging equipment with the tape it needs without requiring the second spool to contemporaneously dispense a corresponding length. As the new spool of tape comes up to speed, the movable roller returns under the influence of the spring to its initial position. An active brake assembly prevents the spool from unduly accelerating in response to this spring-driven lengthening of the tape path by the movable roller.

The foregoing and additional objects, features and advantages of the present invention will be more readily apparent from the following detailed description, which proceeds with reference to the accompanying drawings.

DETAILED DESCRIPTION

Figure 1:
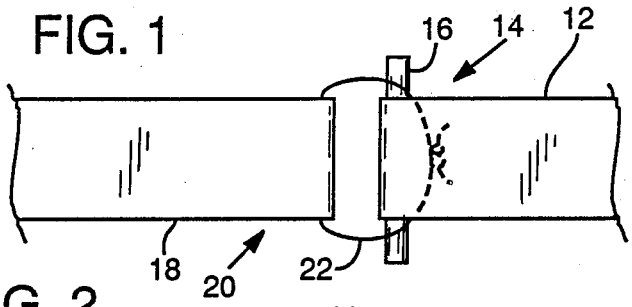
FIG. 1 is an illustration showing the splice formed by cooperation between a pin on the trailing end of a first tape with a loop on the leading end of a second tape.

Referring first to FIG. 1, each tape is provided with end elements which cooperate with end elements on other tapes to make the tapes self-splicing. In FIG. 1, a first tape 12 is provided at its trailing end 14 with a pin end element 16. A second tape 18 is provided at its leading end 20 with a loop element 22. When the pin 16 engages the loop 22, the tape becomes linked, causing the trailing end of the first tape to pull the leading end of the second tape into the machine.

Figure 2:
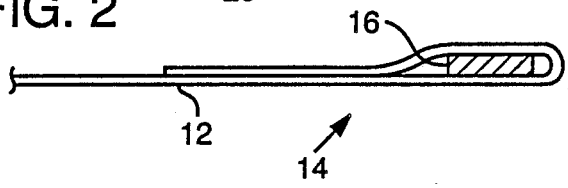
FIG. 2 is an illustration showing how the pin component is affixed to the tape end.

End elements 16 and 22 can be attached to the tapes in a variety of ways. Illustrated in FIG. 2 is a technique applicable with adhesive tapes, such as hot melt tapes, wherein the end element (here a pin 16) is placed on the tape and the tape looped back and adhered to itself. The loop element is affixed similarly.

Figure 3:
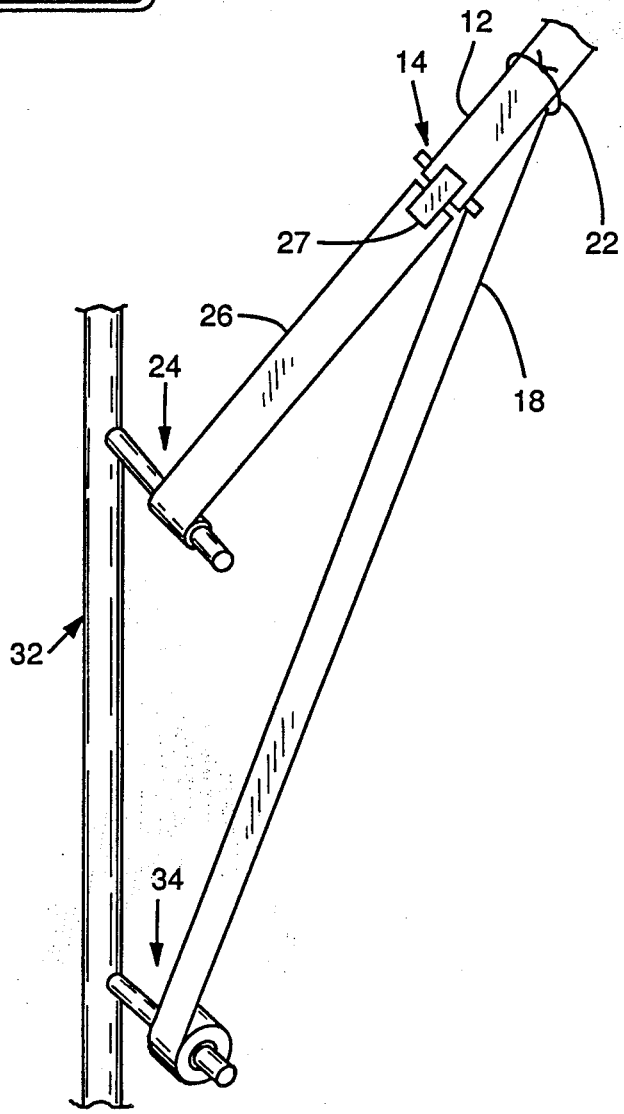
FIG. 3 is an illustration showing a detachable tail on the trailing end of the first tape to maintain proper orientation of the splice.
Figure 4:
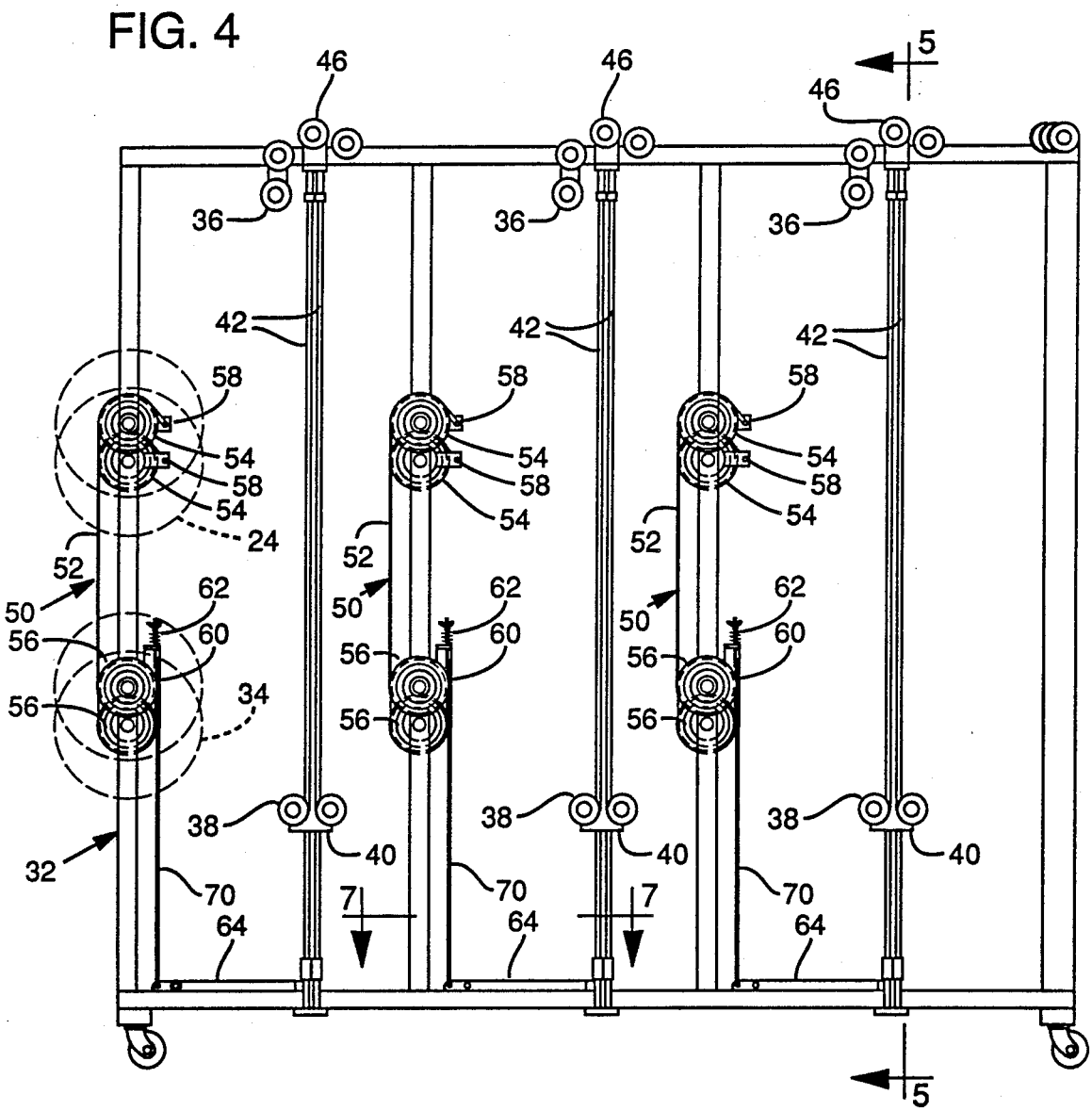
FIG. 4 is a front view of a tape dispensing apparatus employing the tension control system of the present invention.
Figure 6:
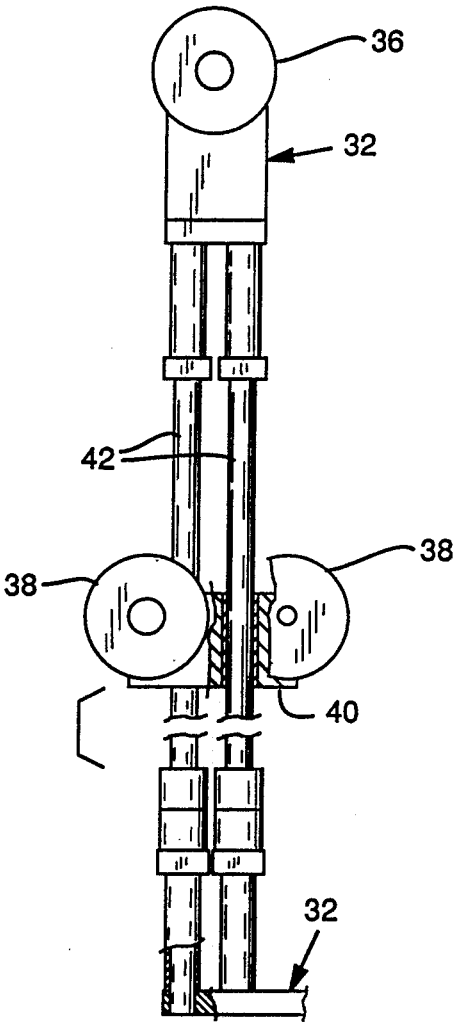
FIG. 6 is a view taken on line 6—6 of FIG. 5.
Figure 5:
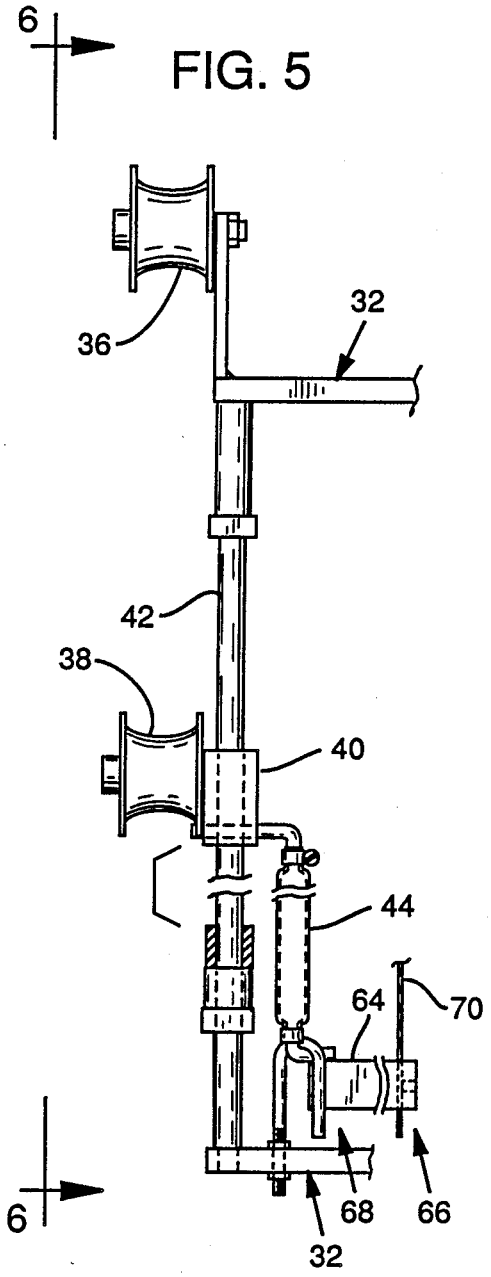
FIG. 5 is a section taken on line 5—5 of FIG. 4.
Figure 7:
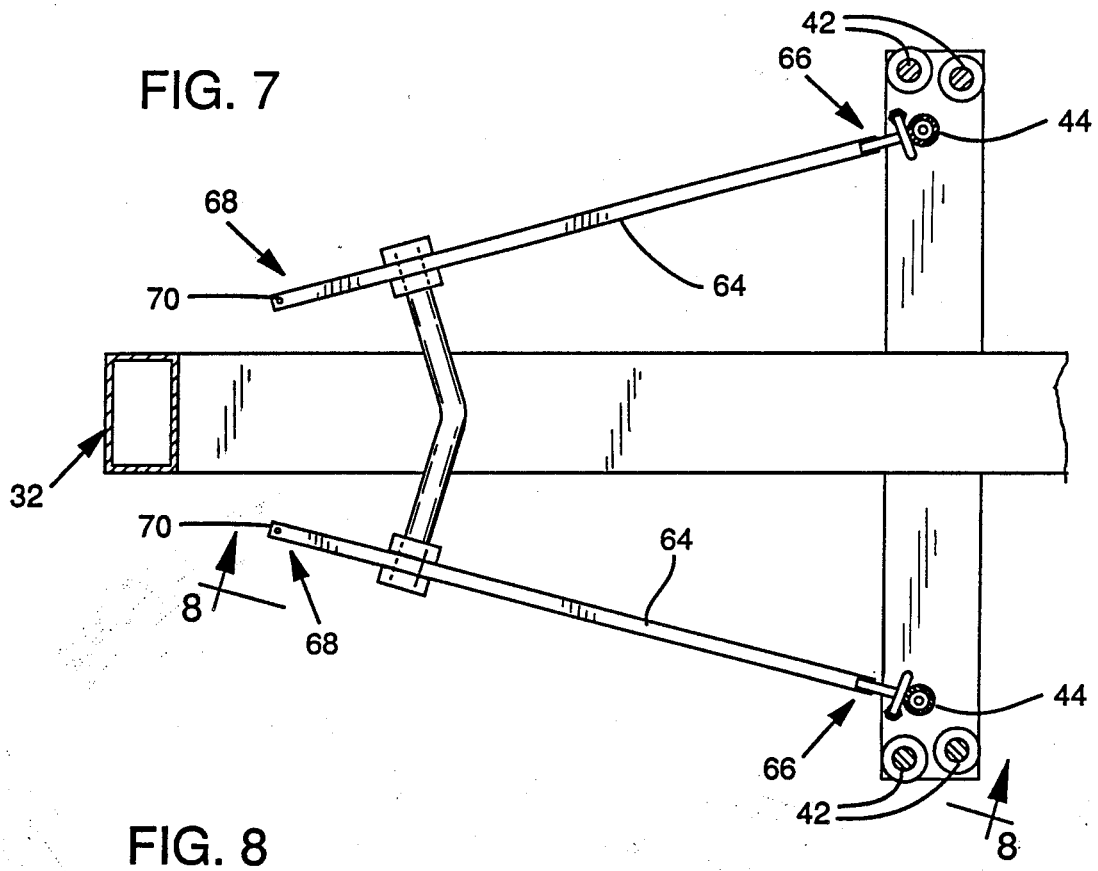
FIG. 7 is a section taken on line 7—7 of FIG. 4.
Figure 8:
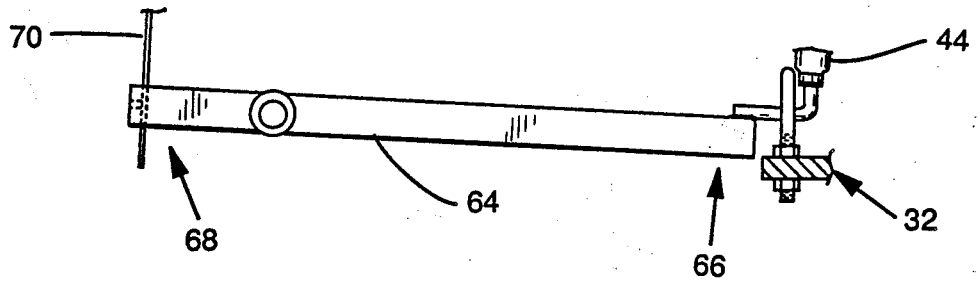
FIG. 8 is a view taken on line 8—8 of FIG. 7.
Figure 9:
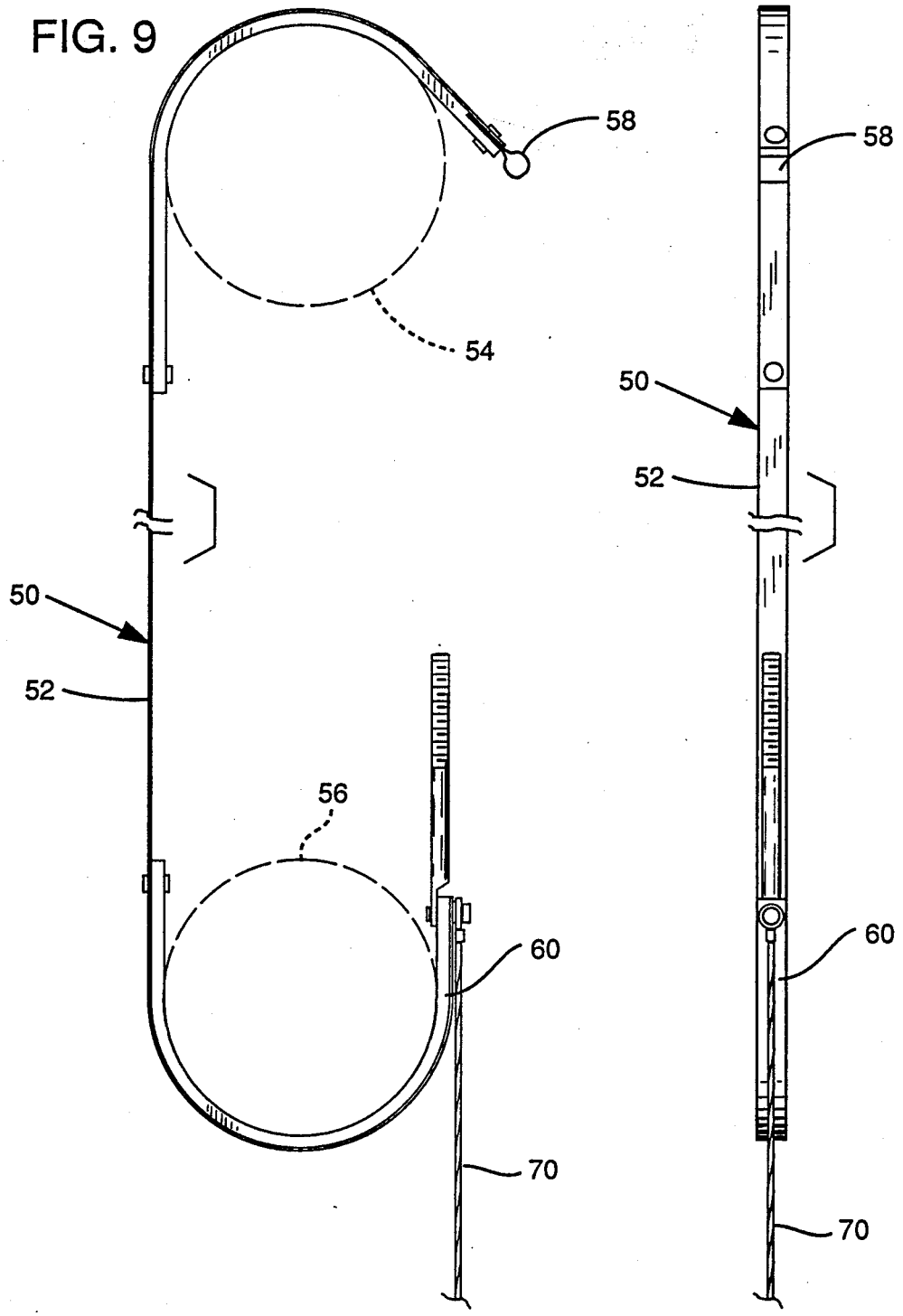
FIG. 9 shows a brake band assembly used with the tension control system of FIG. 4.
Figure 10:
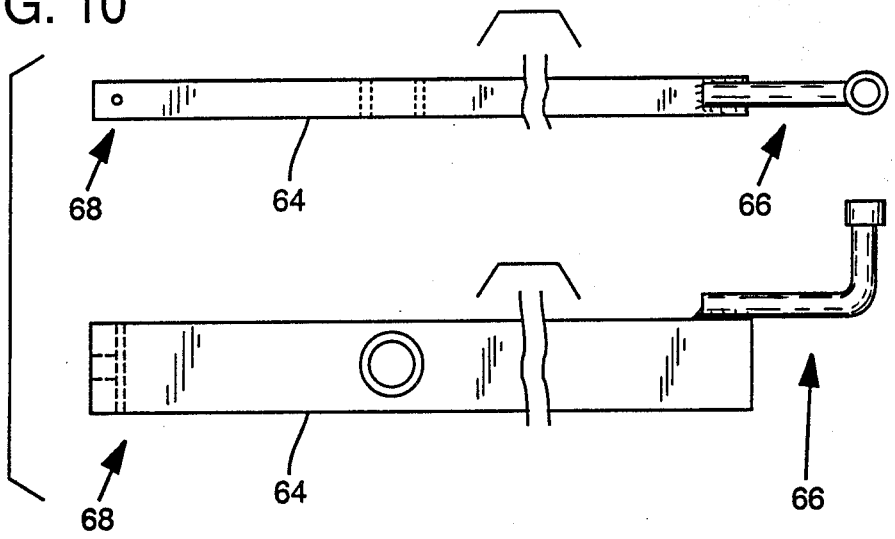
FIG. 10 shows a lever used with the tension control system of FIG. 4.
Figure 11:
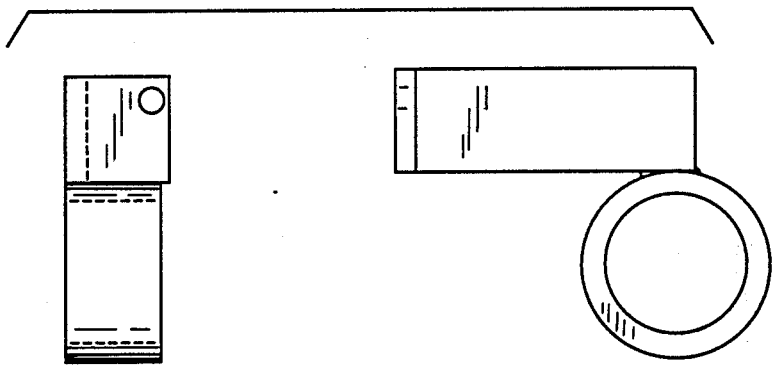
FIG. 11 shows a brake band bracket used with the tension control system of FIG. 4.

FIG. 3 shows the relationship of the two tapes just before the first spool of tape 24 becomes depleted. It will be recognized that some means must be provided for positioning loop 22 around the first tape 12. In the illustrated embodiment, this is achieved by forming end element 16 of reinforced string and tying it in a loop around the first tape. Other techniques could, of course, be used.

When the trailing end 14 of tape 12 comes off spool 24, it would normally be free to twist and turn. Such movement, however, may result in the tape being introduced into the machine wrong side down. The second tape that followed it would likewise be misoriented. To avoid this problem, the trailing end of the first tape 12 is desirably provided with a tail segment 26 affixed to the spool. The tail segment 26 has a length sufficient so that the second tape is linked to the trailing end of the first tape, in the proper orientation, before the end of the tail segment is reached.

In the embodiment shown in FIG. 3, the tail segment 26 is detachably connected to the trailing end of the first tape 12 by means such as masking tape 27. The other end of the tail segment is securely affixed to the spool 24. When the first tape draws the tail segment tight, the masking tape joint is pulled free, leaving the tail segment dangling from the spool and leaving the pin/loop splice free to travel into the machine.

In other embodiments, the tail segment need not be detachable as shown. Instead, it can be securely affixed to the first tape and not connected to the spool. When the end of the tail segment comes free of the spool, it is introduced into the machine and applied just as with any other tape.

Figure 12:
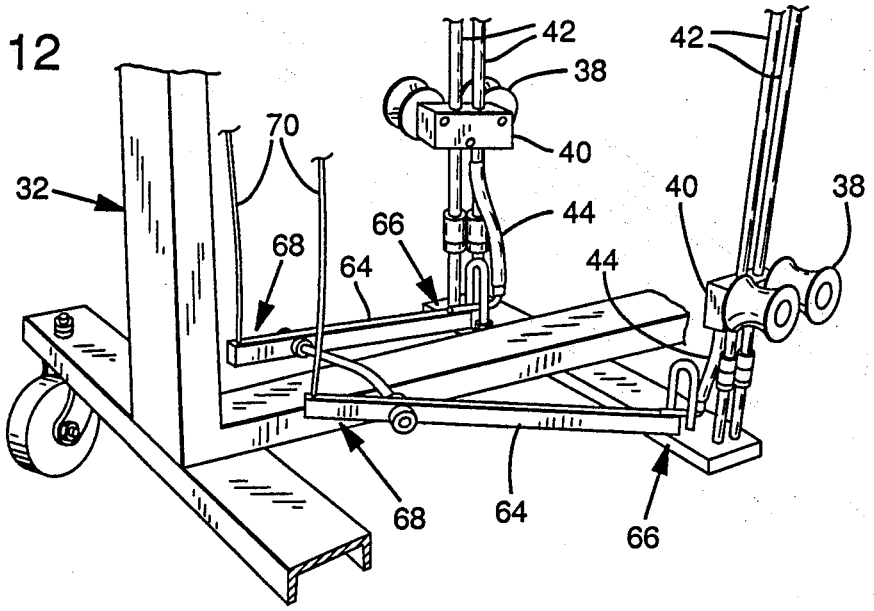
FIG. 12 is a view showing portion of the tension control system of FIG. 4.
Figure 13:
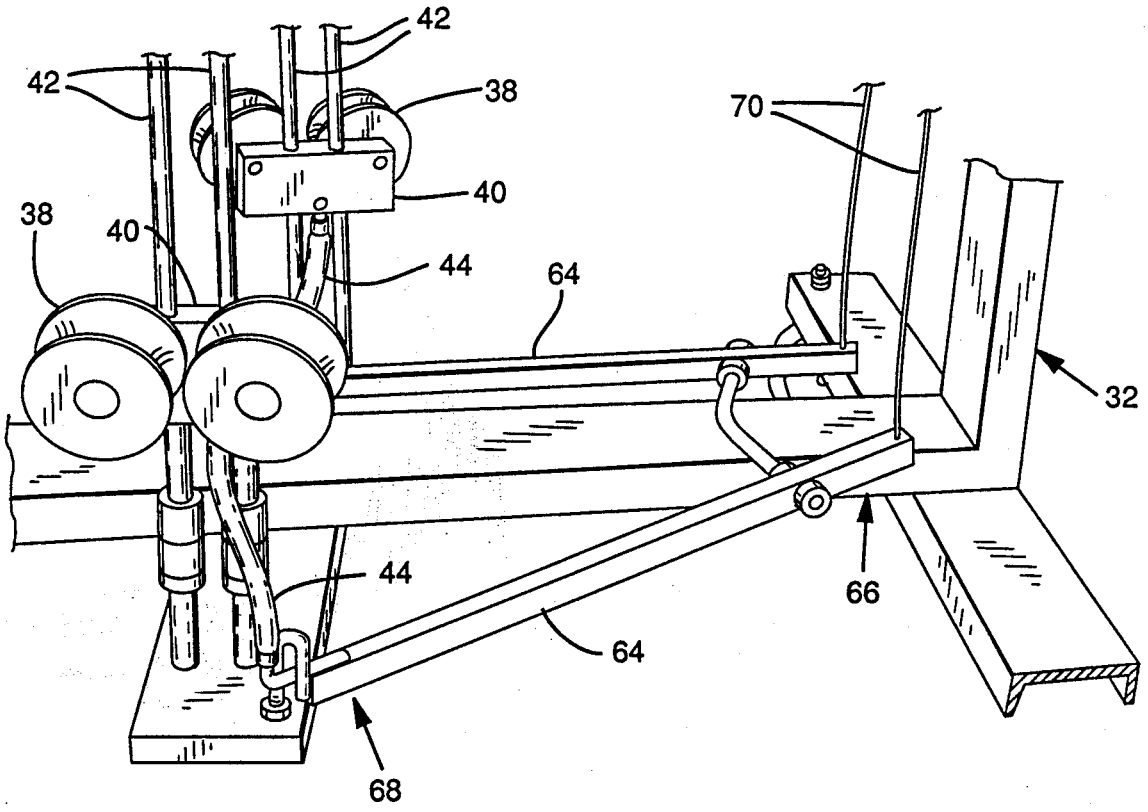
FIG. 13 is a view showing another portion of the tension control system of FIG. 4.
Figure 14:
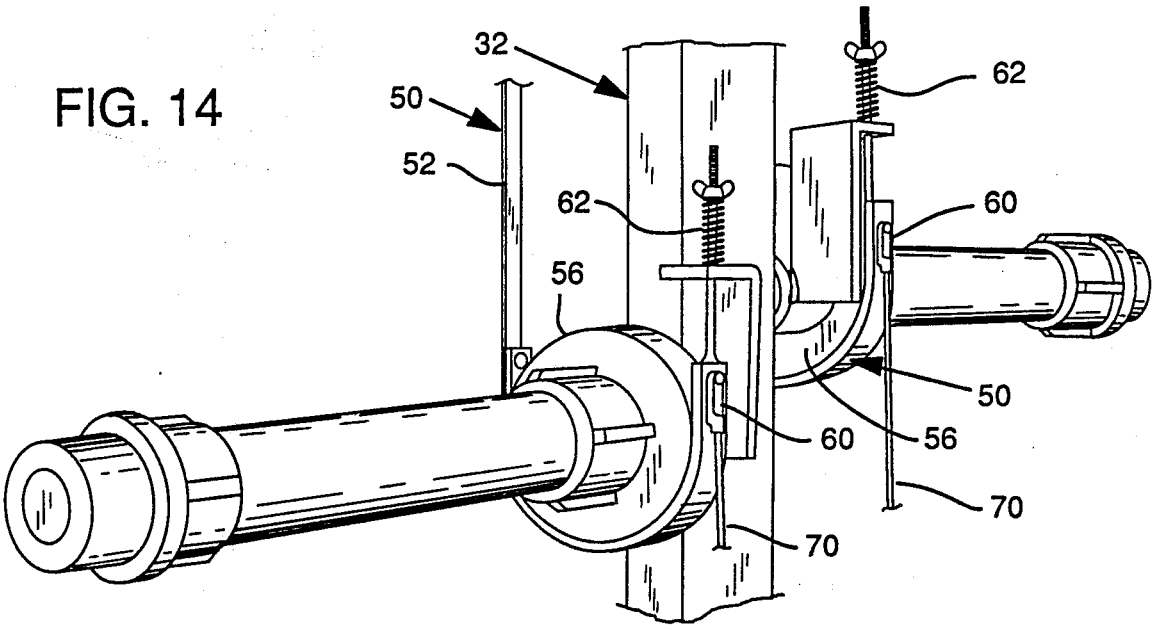
FIG. 14 is a view showing the brake band and the spindles in the tension control system of FIG. 4.
Figure 15:
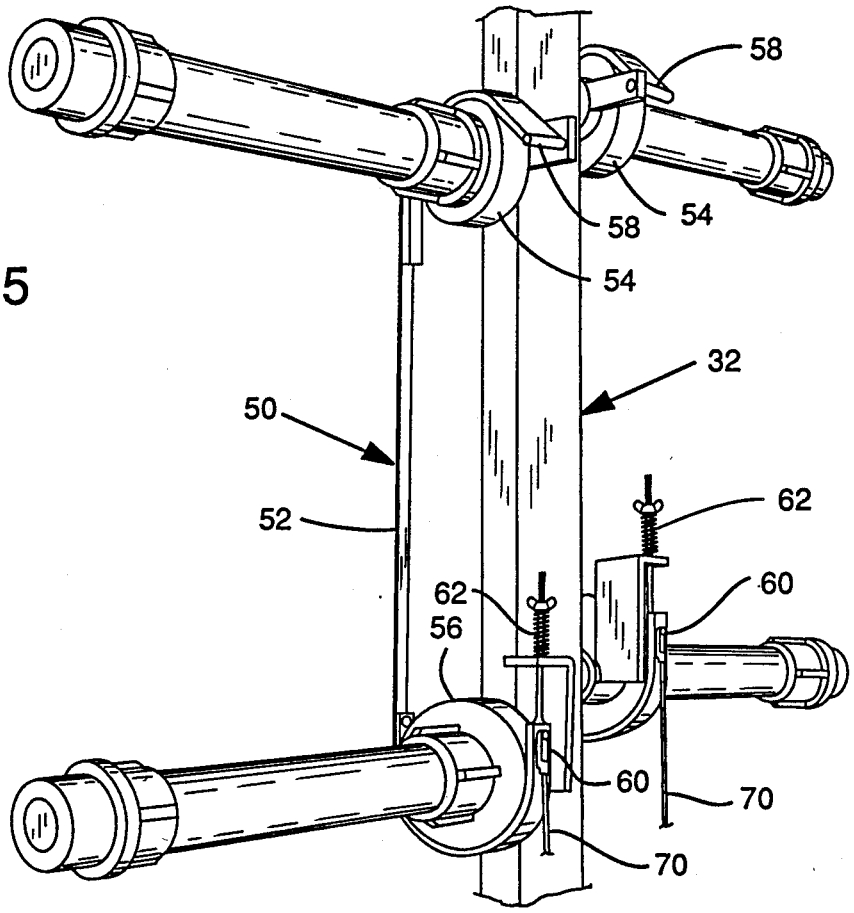
FIG. 15 is another view showing the brake band and the spindles in the tension control system of FIG. 4.

Referring now to FIGS. 4–16, a dispensing apparatus 30 with which the above splicing technique can be employed comprises a frame 32 on when are mounted two spools 24, 34 of tape. Tape is routed from one of these spools over a fixed roller 36 and down to a tensioning roller 38. Tensioning roller 38 is mounted on a block 40 that rides on slider rods 42. The block 40 is pulled downwardly by a spring 44 and upwardly by tension in the tape. (In the illustrated embodiment, the spring 44 is a rubber hose, as is visible in FIG. 12. in other embodiments, other mechanisms could of course be used, such as a hydraulic cylinder, etc.) The tape continues from tensioning roller 38 up over another fixed roller 46 and on into the corrugator equipment.

Figure 16:
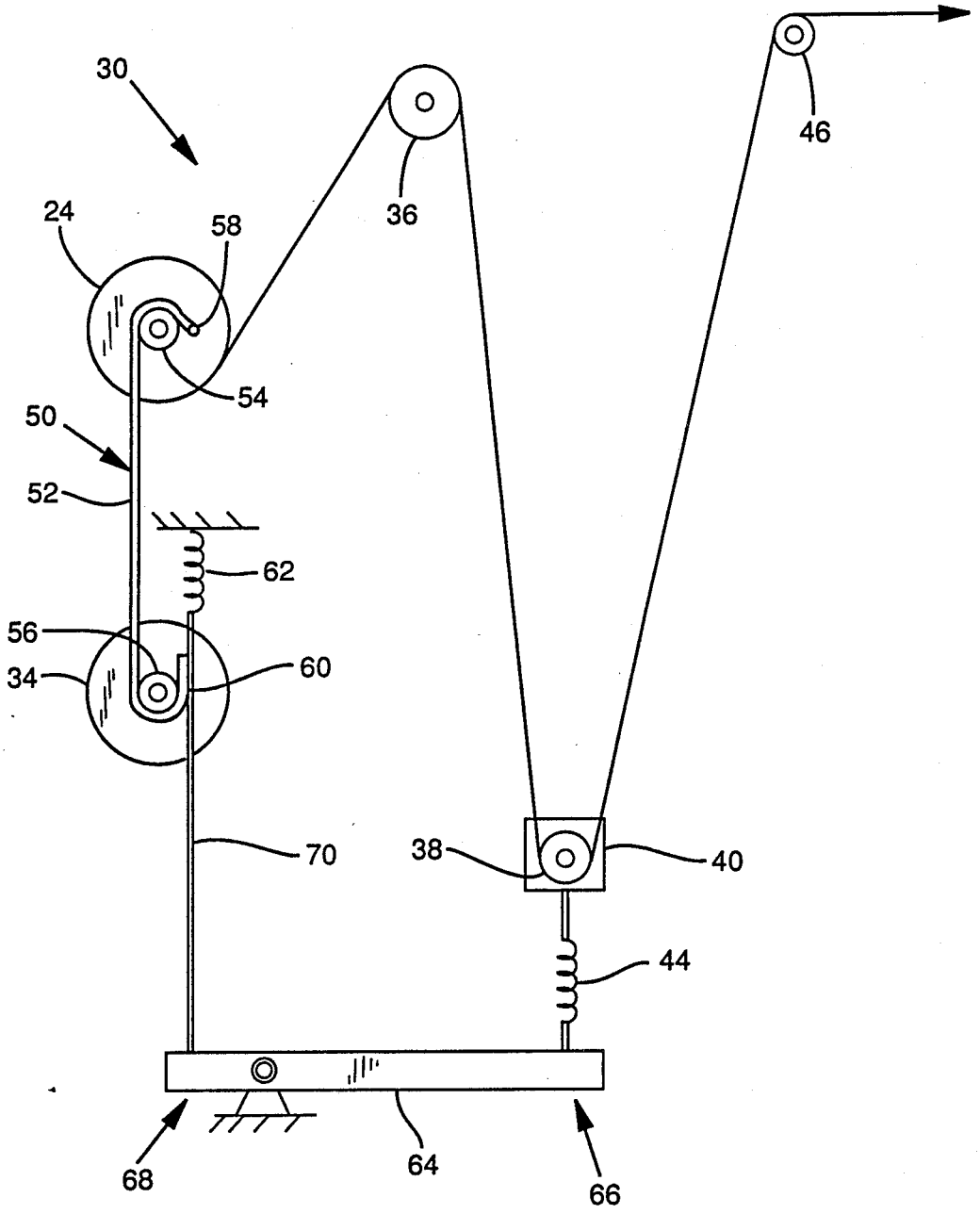
FIG. 16 is a schematic illustration of the tension control system of FIG. 4.

Referring now particularly to FIG. 16, it will be recognized that when the first spool 24 becomes depleted of tape, the above-described splicing technique will suddenly bring the second spool 34 (which had previously been stationary) into action. Since the second spool cannot immediately supply tape at the rate required by the corrugator (typically 600 feet per minute), the tension in the tape suddenly increases. The increased tension causes roller 38 to move upwardly against the force of spring 44. This movement serves to shorten the tape path, thereby providing tape to the corrugator without requiring the second spool to dispense a corresponding length contemporaneously.

After the second spool 34 accelerates to the required speed, the tension in the tape decreases. This permits the roller 38 to be pulled downwardly by spring 44. This movement, however, lengthens the tape path, momentarily pulling tape from the second spool at a rate greater than is required by the corrugator. This momentary oversupply of tape introduces slack into the system which diminishes the force pulling tape from spool 34, permitting it to slow down. When the slack is used up, the spool is no longer operating at the requisite speed and a tension spike occurs when the system again tries to draw tape from the spool faster than it is immediately able to supply it. This in turn causes the tensioning roller 38 to move upwardly against spring 44. The process repeats. The net result is a diminishing series of oscillations in the system, with the tape alternately going slack and too tight until equilibrium is finally established. During the slack intervals, the tape may become misoriented (i.e. wrong side down) or may even jump the rollers.

(Another way of conceptualizing the oscillation phenomenon is that spring 44 absorbs energy applied by the corrugator when the second spool is started and stores it as spring tension. After the second spool accelerates to full operating speed, the spring releases that stored energy back to the system. This released energy is absorbed by the second spool and is stored in the form of a rotational speed higher than is required by the system. This generates an oversupply of free tape so that the pulling force exerted by the corrugator is no longer applied to the spool. The spool slows while the slack is taken up. When the slack is exhausted, the corrugator again exerts a tension spike against the spool (unless the spool is at exactly the speed required by the corrugator). This new tension spike again introduces energy into spring 44 and the cycle repeats).

To overcome this problem, the apparatus 30 is provided with a dynamic brake assembly 50. Brake assembly 50 comprises a brake band 52 which extends about portions of the spindles 54, 56 on which the spools 24, 34 ride and acts to retard their rotation. The upper end 58 of the brake band 52 is stationary, affixed to the frame 32. The lower end 60 is connected to a spring 62 which is connected at its other end to the frame 32. The spring 62 tensions the brake band 52 and establishes a quiescent braking force on spools 24 and 34. As discussed below, the apparatus is provided with means for changing this braking force in response to changes in tape tension.

When tape tension is low (i.e. when the spool is providing tape faster than is required by the corrugator), it is desirable to apply an increased braking force to the spool to retard its dispensing of tape. Conversely, when the tape tension is high, it is desirable to apply a decreased braking force so that the dispensing of tape can be accelerated.

In the illustrated embodiment, one physical indicator of tape tension is the position of tensioning roller 38. When tape tension is high, the roller is elevated. When tape tension is low, the roller assumes a lower position. This motion is advantageously used in the present invention to control the braking force applied to the spools.

As shown in FIG. 16, a lever 64 is pivotally mounted on the frame 32 and extends under the tensioning roller 38 and the braking assembly 50. When tape tension is high, spring 44 pulls upwardly on a first end 66 of the lever, causing the second end 68 of the lever to move downwardly. This movement is coupled to the brake assembly 60 by a member 70 which pulls against brake spring 62, thereby reducing the tension in the brake band and causes a corresponding reduction in the braking force. Conversely, when the tape tension is lowered, the first end 66 of the lever moves downwardly, moving the second end upwardly. This motion permits brake spring 62 to reapply more tensioning force to the brake band 52, thereby causing a corresponding increase in the braking force.

From the foregoing, it will be recognized that the present invention employs a feedback mechanism that senses the tension in the tape and automatically adjusts the braking force in response thereto.

It will be noted that the brake band 52 extends 180 degrees about the lower spindle 56, but a lesser distance about the upper spindle 54. This reflects the fact that the weight of the brake band 52 hanging down from the upper spindle applies a tensioning force to the brake band on the upper spindle that is not present on the lower spindle. It is desirable that the braking forces applied to the two spindles be matched, although this is not a requirement of the invention.

FIGS. 4–6 and 12–15 show a tape dispensing apparatus that incorporates six of the assemblies shown in FIG. 16.

Having described and illustrated the principles of our invention with reference to a preferred embodiment, it will be apparent to those having skill in the art that the invention can be modified in arrangement and detail without departing from such principles. For example, while a braking assembly has been shown for quickly dampening undesirable oscillations in the system, in other embodiments, a variety of other techniques can be used to absorb the excess energy. In still other embodiments, the replacement spool is accelerated in response to electrical or mechanism sensors that indicate that the initial spool is about to be depleted.

In view of these and the wide range of other embodiments to which the concepts of the present invention can be applied, it should be recognized that the foregoing description is illustrative only and is not to be construed as limiting the scope of the invention. Instead, we claim as our invention all such modifications as may come within the scope and spirit of the following claims and equivalents thereof.

We claim:

1. In an apparatus for dispensing elongated material from a roll, a system for regulating the tension in the material, comprising:

guide means for defining the path the elongated material is to follow, said guide means including at least one guide member movable in response to increased tension in the material to shorten the path thereof and movable in response to decreased tension in the material to lengthen the path thereof and movable in response to decreased tension in the material to lengthen the path thereof;

active brake means for applying a braking force to the roll;

a pivoted lever coupling the movable guide member to the active brake means;

said pivoted lever and active brake means cooperating to reduce the braking force when the movable guide member moves to shorten the aforesaid path length and to increase the braking force when the movable guide member moves to lengthen the aforesaid path length;

a second roll, the first and second rolls being mounted on first and second spindles, respectively; and mechanical, non-adhesive linkage means for linking the elongated material on the first roll to the elongated material on the second roll so that when the first roll is depleted of material, the second roll can immediately begin supplying material in its stead.

2. The apparatus of claim 1 in which the active braking means includes means for applying a braking force to both of said rolls.

3. The apparatus of claim 2 in which the active braking means comprises a brake band extending at least partially around the first and second spindles.

4. The apparatus of claim 3 in which the brake band extends different distances around the first and second spindles.

5. The apparatus of claim 3 which includes means responsive to the position of the movable guide member for controlling the tension in the brake band.

6. The apparatus of claim 1 in which the coupling means comprises:

a first coupling member disposed on the first material near the trailing end thereof; and a second coupling member disposed on the second material near the leading end thereof;

the first and second coupling members cooperating to link the leading end of the second material to the trailing end of the first material so that an uninterrupted supply of material can be provided.

7. The apparatus of claim 6 in which:

the first coupling member comprises an obstacle; and the second coupling member defines a passageway through which the obstacle cannot pass.

8. The apparatus of claim 7 in which:

the elongated material comprises tape;

the first coupling member comprises a pin extending transversely across the tape, the pin having a length longer than the width of the tape; and the second coupling member comprises means for forming a loop around the first tape in which the pin can engage.

9. The apparatus of claim 6 which further includes:

tail means coupling the obstacle portion of the first elongated material to the first spindle so that the obstacle maintains a desired orientation relative to the spindle when the first roll becomes depleted and the second roll begins dispensing in its stead.

10. The apparatus of claim 9 in which the tail means is fixedly coupled to the spindle and detachably coupled to the obstacle portion of the material so that the tail means will become detached from the material when the second roll begins dispensing material.

11. A spool of reinforcing or tear tape from which tape can be dispensed, comprising a rolled length of tape having on a leading end thereof means for forming a loop and having on a trailing end thereof an obstacle extending across and beyond the width of the tape.

12. In a tape dispensing apparatus, an improvement comprising:

first and second spools of tape, the tape on each of said spools having a leading end and a trail end; and an element on the trailing end of the first tape that cooperates with an element on the leading end of the second tape to make said second spool of tape self splicing to the first so that when the first spool becomes depleted of tape, the second spool can begin immediately dispensing tape in its stead.

13. The invention of claim 12 in which:

the element on the trailing end of the first tape comprises a pin extending transversely across the tape, the pin having a length longer than the width of the tape; and the element on the leading end of the second tape comprises means for forming a loop around the first tape in which the pin can engage.

14. The invention of claim 12 which further includes brake means responsive to the tension in the tape being dispensed for applying a variable braking force to said spools.

15. The invention of claim 14 in which:

the brake means includes a movable control member for controlling the braking force applied to the spools;

the dispensing apparatus includes:

a tape guide member movable in response to tension in the tape being dispensed; and a mechanical linkage coupled to the movable guide member and to the movable control member for controlling the braking force in response to the position of the guide member.

16. The invention of claim 15 in which the mechanical linkage comprises a pivoted lever.

17. The invention of claim 12 which further comprises means for preventing the first or second tape from changing its orientation during a transition from the first spool to the second.

18. The invention of claim 17 in which the trailing end of the first tape is coupled to a tail portion wrapped about the first spool, whereby said trailing end is not free when it is dispensed from the spool.

19. The invention of claim 18 in which the tail portion is securely affixed to the first spool and less securely affixed to the trailing end, whereby the trailing end will separate from the spool at the junction between the trailing end and the tail portion.

20. The invention of claim 12 which further comprises means for preventing the first or second tape from going slack during a transition from the first spool to the second.

21. In a tape dispensing apparatus that includes two spools of tape, an apparatus for applying a variable but equal braking force to each of said spools comprising:

first and second spindles to which the spools can be mounted;

first and second anchor points fixed at positions adjacent the first and second spindles, respectively;

a spring having first and second ends, the first end being connected to the first anchor point;

a brake band having a first end connected to the second anchor point and a second end connected to the second end of the spring, the brake band extending at least partially around and in engagement with the first and second spindles; and a control member coupled to the second end of the spring for controlling the tension therein.

* * * * *